US008430679B1

(12) United States Patent
Long et al.

(10) Patent No.: US 8,430,679 B1
(45) Date of Patent: Apr. 30, 2013

(54) ROTATABLE POWER STRIP

(75) Inventors: Ling Long, Shenzhen (CN); Li-Ren Fu, Shenzhen (CN)

(73) Assignees: Hong Fu Jin Precision Industry (ShenZhen) Co., Ltd., Shenzen (CN); Hon Hai Precision Industry Co., Ltd., New Taipei (TW)

( * ) Notice: Subject to any disclaimer, the term of this patent is extended or adjusted under 35 U.S.C. 154(b) by 5 days.

(21) Appl. No.: 13/326,256

(22) Filed: Dec. 14, 2011

(30) Foreign Application Priority Data

Oct. 20, 2011 (CN) ..... 2011 1 0320576

(51) Int. Cl.
*H01R 25/00* (2006.01)

(52) U.S. Cl.
USPC ..... 439/118; 439/620.21

(58) Field of Classification Search ..... 439/118, 439/117, 106, 211, 209, 620.1
See application file for complete search history.

(56) References Cited

U.S. PATENT DOCUMENTS

| | | | | |
|---|---|---|---|---|
| 3,081,442 | A * | 3/1963 | Platz | 439/94 |
| 5,759,051 | A * | 6/1998 | Cancellieri et al. | 439/118 |
| 6,325,645 | B1 * | 12/2001 | Schuite | 439/110 |
| 7,094,077 | B1 * | 8/2006 | Chen | 439/118 |
| 7,544,071 | B2 * | 6/2009 | Jong | 439/113 |

* cited by examiner

*Primary Examiner* — James Harvey
(74) *Attorney, Agent, or Firm* — Altis Law Group, Inc.

(57) ABSTRACT

A rotatable power strip includes a base, a cover, a fixing member fixed to the base, and a socket. Two opposite first conductive pieces and a second conductive piece between the first conductive pieces are mounted to the base. The socket is rotatably mounted to the base. A top of the socket is exposed out of the cover. Two first conductive pins and a second conductive pin are mounted to a bottom of the socket. The second conductive pin is arranged between the first conductive pins and engages with the second conductive piece. The socket is rotated around the second conductive pin. The fixing member is capable of locking the socket to a conductive position where the first conductive pins respectively engage with the first conductive pieces, and a non-conductive position where the first conductive pins respectively disengage from the first conductive pieces.

17 Claims, 5 Drawing Sheets

ROTATABLE POWER STRIP

BACKGROUND

1. Technical Field

The present disclosure relates to a power strip.

2. Description of Related Art

A power strip generally includes a number of sockets, and a number of switches respectively connected to the sockets, to control the sockets in a connected state or a disconnected state. However, mounting so many switches is a waste of resources. Furthermore, directions of the sockets are always fixed, sometimes it is inconvenient for inserting a plug in a corresponding socket.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawing, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
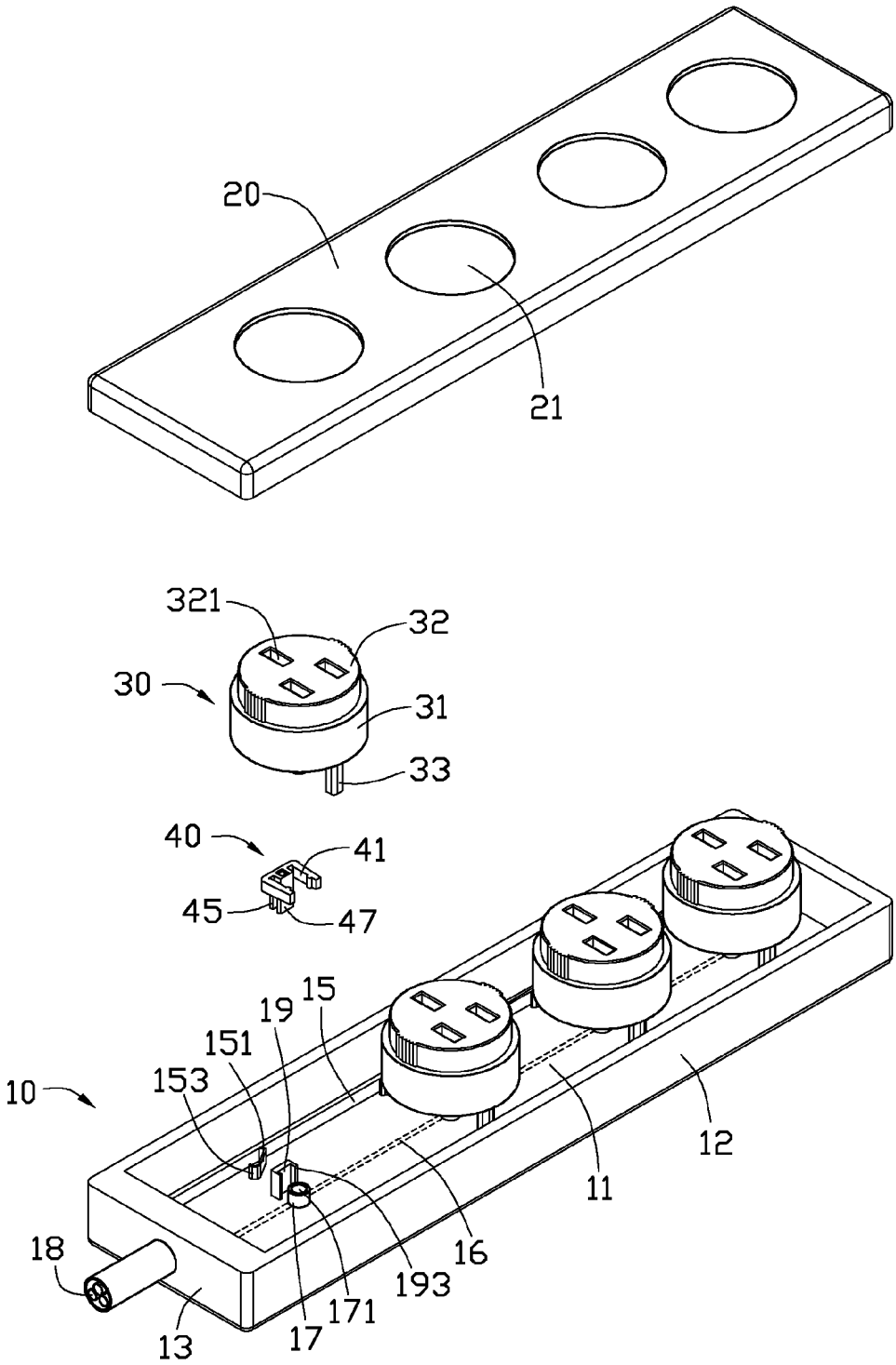
FIG. 1 is an exploded, isometric view of an exemplary embodiment of a rotatable power strip, wherein the power strip includes a socket and a fixing member.
Figure 2:
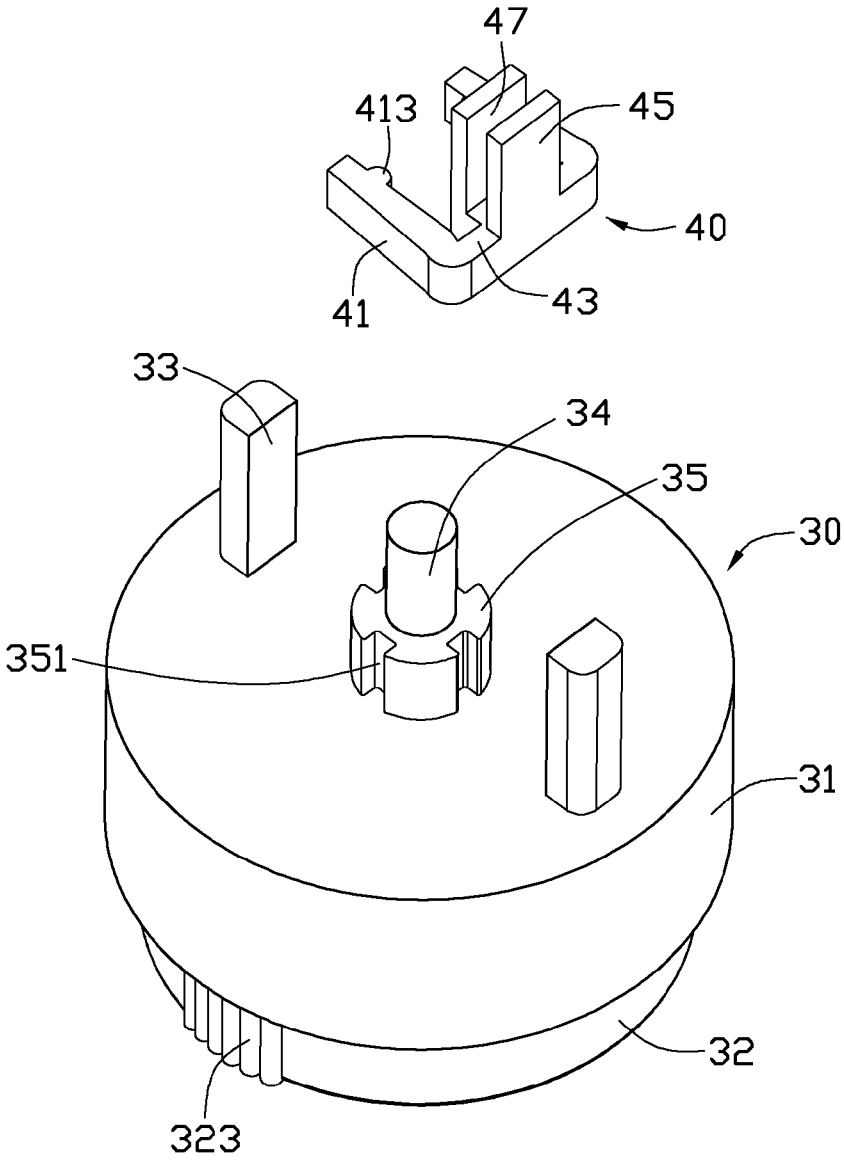
FIG. 2 is an inverted, enlarged view of the socket and the fixing member of FIG. 1.

FIGS. 1 and 2, show an exemplary embodiment of a rotatable power strip including a base 10, a cover 20, a plurality of sockets 30, and a plurality of fixing members 40.

The base 10 includes a bottom wall 11, two sidewalls 12 respectively extending up from opposite sides of the bottom wall 11, and two end walls 13 respectively extending up from opposite ends of the bottom wall 11. Two elongated first conductive pieces 15 are mounted to the top of the bottom wall 11, respectively adjacent and parallel to the sidewalls 13. Each first conductive piece 15 forms a plurality of spaced and opposite aligned resilient tabs 151 slantingly extending towards the opposite first conductive piece 15. A distal end of each resilient tab 151 is bent towards the adjacent first conductive piece 15 to form a slanted guiding portion 153. An elongated second conductive piece 16 is mounted inside a middle section of the bottom wall 11, parallel to the sidewalls 12. A plurality of posts 17 perpendicularly extend up from the middle section of the bottom wall 11 above the second conductive piece 16. Each post 17 is arranged between two aligned resilient tabs 151. A through hole 171 is defined in each post 17. The second conductive piece 16 is exposed through the bottom end of the through hole 171. Three cables 18 extend through one of the end walls 13, and are respectively electrically connected to the first and second conductive pieces 15 and 16. One of the cables 18 connected to the second conductive piece 16 is connected to ground. A plurality of spaced fixing plates 19 extends up from the bottom wall 11, respectively adjacent to the posts 17. Two bent portions 193 respectively extend from opposite sides of each fixing plate 19 in a substantially perpendicular manner, toward the corresponding post 17.

The cover 20 is detachably covered to the base 10. A plurality of circular openings 21 is defined in the cover 20, corresponding to the posts 17.

Each socket 30 includes a cylindrical mounting portion 31, a cylindrical connecting portion 32 protruding up from the middle of the top of the mounting portion 31. Two first conductive pins 33 extending down form the bottom of the mounting portion 31, and a second conductive pin 34 extending down from the middle of the bottom of the mounting portion 31 between the first conductive pins 33. Three holes 321 are defined in the top of the connecting portion 32, in which a three-pin plug can be inserted. The second conductive pin 34 is electrically connected to a grounded one of the holes 321, and the first conductive pins 33 are respectively electrically connected to the other two holes 321. Two operable protrusions 323 extend from opposite sides of a circumference of the connecting portion 32. A circular pivot portion 35 is formed on the middle of the bottom of the mounting portion 31, surrounding the upper section of the second conductive pin 34. Four equally spaced notches 351 are defined in a circumference of the pivot portion 35, with two of the notches 351 respectively aligning with the first conductive pins 33.

Each fixing member 40 includes two opposite fixing arms 41, a connecting arm 43 connected between the first ends of the fixing arms 41, a first plate 45 extending down from the bottom of the connecting arm 43, and a second plate 47 extending down from a side of the connecting arm 43 facing the fixing arms 41. The second plate 47 is parallel to the first plate 47. Two latching portions 413 extend toward each other from inner sides of the fixing arms 41, adjacent to second ends of the fixing arms 41 opposite to the first ends.

Figure 3:
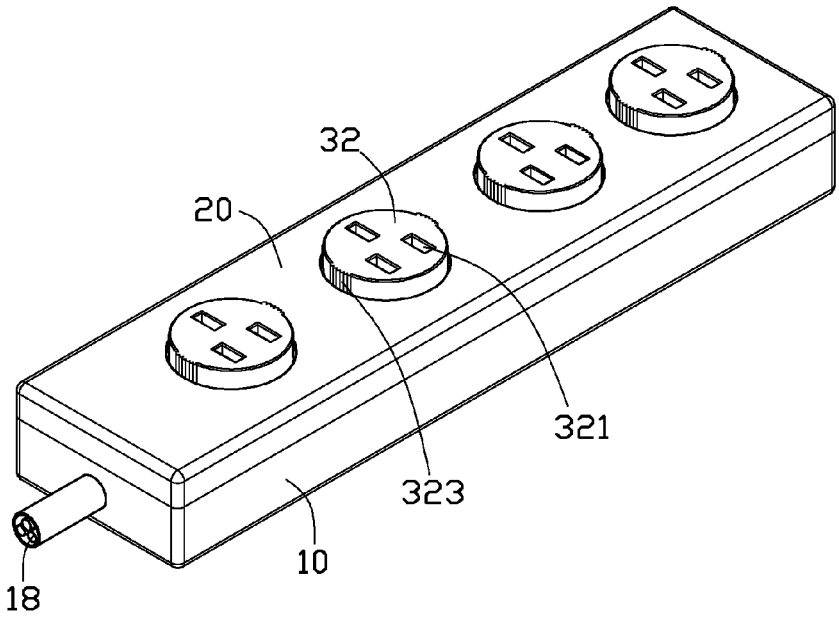
FIG. 3 is an assembled, isometric view of the power strip of FIG. 1.
Figure 4:
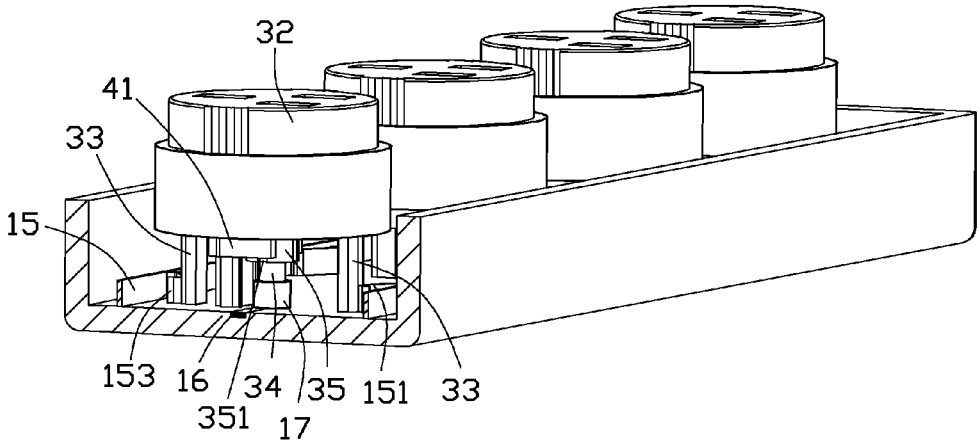
FIG. 4 is a partially cut-away view of the power strip of FIG. 3, wherein the socket is in a conductive state.

FIGS. 3 and 4, in assembly, the fixing members 40 are respectively fixed to the fixing plates 19, to allow each fixing plate 19 to be sandwiched between the corresponding first and second plates 45 and 47, and to allow each second plate 47 to be sandwiched between two corresponding bent portions 193. The fixing arms 41 of each fixing member 40 are arranged over opposite sides of the corresponding post 17. The second conductive pins 34 are respectively inserted into the corresponding through holes 171, to allow the bottoms of the second conductive pins 34 to engage and contact with the second conductive piece 16, and to allow each pivot portion 35 to be sandwiched between two corresponding fixing arms 41. The sockets 30 are rotated, to allow the first conductive pins 33 of each socket 30 to engage with two corresponding resilient tabs 151 guided by the corresponding guiding portions 153. Thus, allowing the latching portions 413 of each fixing member 40 to engage in two opposite notches 351 of the corresponding pivot portion 35, locking the sockets 30 to a conductive position.

The cover 20 is covered on the base 10. The connecting portions 32 respectively extend through the openings 21, and are exposed out of the cover 20 through the openings 21. The mounting portions 31 engage with the inner surface of the cover 20. Therefore, the rotatable power strip is assembled.

Figure 5:
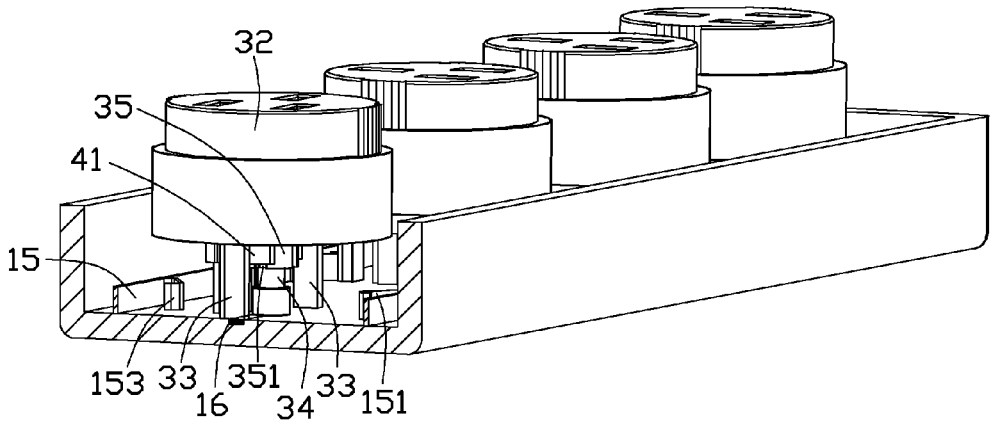
FIG. 5 is similar to FIG. 4, but shows the socket in a non-conductive state.

FIG. 5, shows one of the sockets 30 in a non-conductive state. The protrusions 323 are operated to allow the socket 30 to rotate clockwise or anticlockwise. The corresponding fixing arms 41 are deformed, to allow the latching portions 413 to disengage from the corresponding two notches 351. When the socket 30 is rotated 90 degrees, the corresponding fixing arms 41 are restored, to allow the latching portions 413 to engage in other two notches 351. The socket 30 is locked again. The first conductive pins 33 of the socket 30 are disengaged from the corresponding resilient tabs 151, thereby, the socket 30 is in a non-conductive state.

FIG. 4, shows reconnecting the socket 30. The socket 30 is rotated clockwise or anticlockwise 90 degrees, to allow the first conductive pins 33 of the socket 30 to reengage with the corresponding resilient tabs 151. If the socket 30 is rotated 360 degrees, the socket 30 can be locked to two conductive positions and two non-conductive positions.

Even though numerous characteristics and advantages of the embodiments have been set forth in the foregoing description, together with details of the structure and the functions of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A rotatable power strip, comprising:

a base, two opposite first conductive pieces and a second conductive piece mounted to the base, wherein the second conductive piece is arranged between the two first conductive pieces;

a cover covered on the base;

a fixing member fixed to the base; and a socket rotatably mounted to the base, a top of the socket exposed out of the cover and defining three holes for connecting a three-pin plug, two first conductive pins and a second conductive pin mounted to a bottom of the socket and respectively electrically connected to the holes, wherein the second conductive pin is arranged between the first conductive pins and engages and contacts with the second conductive piece, the socket is to be rotated around the second conductive pin such that the fixing member is capable of locking the socket to a conductive position where the first conductive pins respectively engage and contact with the first conductive pieces, or to a non-conductive position where the first conductive pins respectively disengage from the first conductive pieces.

2. The rotatable power strip of claim 1, wherein each first conductive piece forms a resilient tab slantingly extending towards the opposite first conductive piece, when the socket is locked to the conductive position, the first conductive pins respectively engage with the resilient tabs.

3. The rotatable power strip of claim 2, wherein a distal end of each resilient tab is bent towards the adjacent first conductive piece to form a slanted guiding portion.

4. The rotatable power strip of claim 1, wherein a post is formed on the base above the second conductive piece, a through hole is defined in the post, the second conductive piece is exposed through a bottom end of the through hole, the second conductive pin is rotatably received in the through hole, and a bottom of the second conductive pin is extended through the through hole and engages and contacts with the second conductive piece.

5. The rotatable power strip of claim 1, wherein the second conductive pin is electrically connected to a grounding one of the holes of the socket, and the second conductive piece is electrically connected to a grounded cable.

6. The rotatable power strip of claim 1, wherein the fixing member comprises two opposite fixing arms, two latching portions extend toward each other from inner sides of the fixing arms, a circular pivot portion is formed on the bottom of the socket surrounding an upper section of the second conductive pin, the pivot portion is sandwiched between the fixing arms, four equally spaced notches are defined in a circumference of the pivot portion, when the socket is rotated to the conductive position, the latching portions respectively engage in two opposite notches; when the socket is rotated to the non-conductive position, the latching portions respectively engage in the other two opposite notches.

7. The rotatable power strip of claim 6, wherein the fixing member further comprises a connecting arm connected between the fixing arms, a first plate extending down from a bottom of the connecting arm, and a second plate extending down from a side of the connecting arm facing the fixing arms, the second plate is parallel to the first plate, a fixing plate is formed on the base to be sandwiched between the first and second plates.

8. The rotatable power strip of claim 7, wherein two bent portions respectively extend from opposite sides of the fixing plate in a substantially perpendicular manner, to sandwich the second plate.

9. The rotatable power strip of claim 1, wherein the socket comprises a cylindrical mounting portion, a cylindrical connecting portion protruding up from a middle of a top of the mounting portion, the connecting portion is exposed out of the cover, the holes are defined in a top of the connecting portion, and the first and second conductive pins are mounted to a bottom of the mounting portion.

10. The rotatable power strip of claim 9, wherein two operable protrusions extend from opposite sides of a circumference of the connecting portion.

11. A rotatable power strip, comprising:

a base;

at least one first conductive piece mounted to the base;

a second conductive piece mounted to the base;

a cover covered on the base;

a fixing member fixed to the base; and a socket rotatably mounted to the base, a top of the socket exposed out of the cover and defining at least one first hole and a second hole for receiving a plug; at least one first conductive pin correspondingly and electrically connected to the at least one first hole and a second conductive pin correspondingly and electrically connected to the second hole, both the at least one first conductive pin and the second conductive pin being mounted to a bottom of the socket, wherein the second conductive pin contacts with the second conductive piece, the socket is to be rotated around the second conductive pin such that the fixing member locks the socket to a conductive position where the at least one first conductive pin engages and contacts with the at least one first conductive piece, or to a non-conductive position where the at least one first conductive pin respectively disengages from the at least one first conductive piece.

12. The rotatable power strip of claim 11, wherein a post is formed on the base above the second conductive piece, a through hole is defined in the post, the second conductive piece is exposed through a bottom end of the through hole, the second conductive pin is rotatably received in the through hole, and a bottom of the second conductive pin is extended through the through hole and engages and contacts with the second conductive piece.

13. The rotatable power strip of claim 11, wherein the fixing member comprises two opposite fixing arms, two latching portions extend toward each other from inner sides of the fixing arms, a circular pivot portion is formed on the bottom of the socket surrounding an upper section of the second conductive pin, the pivot portion is sandwiched between the fixing arms, four equally spaced notches are defined in a circumference of the pivot portion, when the socket is rotated to the conductive position, the latching portions respectively engage in two opposite notches; when the socket is rotated to the non-conductive position, the latching portions respectively engage in the other two opposite notches.

14. The rotatable power strip of claim 13, wherein the fixing member further comprises a connecting arm connected between the fixing arms, a first plate extending down from a bottom of the connecting arm, and a second plate extending down from a side of the connecting arm facing the fixing arms, the second plate is parallel to the first plate, a fixing plate is formed on the base to be sandwiched between the first and second plates.

15. The rotatable power strip of claim 14, wherein two bent portions respectively extend from opposite sides of the fixing plate in a substantially perpendicular manner, to sandwich the second plate.

16. The rotatable power strip of claim 11, wherein the socket comprises a cylindrical mounting portion, a cylindrical connecting portion protruding up from a middle of a top of the mounting portion, the connecting portion is exposed out of the cover, the at least one first hole and the second hole are defined in a top of the connecting portion, and the at least one first conductive pin and the second conductive pin are mounted to a bottom of the mounting portion.

17. The rotatable power strip of claim 16, wherein two operable protrusions extend from opposite sides of a circumference of the connecting portion.

* * * * *